United States Patent [19]

Chibnik et al.

[11] 4,011,167

[45] Mar. 8, 1977

[54] LUBRICANT COMPOSITIONS CONTAINING METAL COMPLEXES AS DETERGENTS

[75] Inventors: Sheldon Chibnik, Cherry Hill; Ferdinand P. Otto, Woodbury, both of N.J.

[73] Assignee: Mobil Oil Corporation, New York, N.Y.

[22] Filed: July 9, 1975

[21] Appl. No.: 594,410

[52] U.S. Cl. ..... 252/42.7; 252/49.7; 252/51.5 A; 260/326.5 F; 260/429.9; 260/439 R

[51] Int. Cl.[2] ..... C10M 1/54

[58] Field of Search ..... 252/42.7, 49.7, 51.5 A; 260/326.5 F, 429.9, 439 R

[56] References Cited

UNITED STATES PATENTS

| | | | |
|---|---|---|---|
| 2,628,942 | 2/1953 | Morris et al. | 252/49.7 |
| 3,219,666 | 11/1965 | Norman et al. | 252/51.5 A X |
| 3,306,908 | 2/1967 | LeSuer | 252/42.7 X |
| 3,426,024 | 2/1969 | Harvey | 260/429.9 X |
| 3,442,808 | 5/1969 | Traise et al. | 252/51.5 A X |
| 3,454,496 | 7/1969 | Schlobohm et al. | 252/42.7 X |
| 3,459,661 | 8/1969 | Schlobohm | 252/42.7 |
| 3,493,508 | 2/1970 | Andress | 252/49.7 X |
| 3,557,171 | 1/1971 | Andress | 260/429.9 |
| 3,642,847 | 2/1972 | Otto et al. | 252/42.7 X |
| 3,649,659 | 3/1972 | Otto et al. | 260/429.9 X |
| 3,649,661 | 3/1972 | Otto et al. | 252/42.7 X |
| 3,652,616 | 3/1972 | Watson et al. | 252/49.7 X |
| 3,779,922 | 12/1973 | LeSuer | 252/51.5 A X |
| 3,945,933 | 3/1976 | Chibnik et al. | 252/50 X |

*Primary Examiner*—Delbert E. Gantz
*Assistant Examiner*—Andrew H. Metz
*Attorney, Agent, or Firm*—Charles A. Huggett; Raymond W. Barclay; Howard M. Flournoy

[57] ABSTRACT

Lubricant compositions are provided containing a detergency improving amount of a metal complex prepared by (a) reacting a salt or oxide of a metal capable of forming a Werner complex with a compound containing at least one phenolic group to yield the metal salt of said compound; (b) reacting the resulting metal salt with a polyamine having the formula $H_2N(C_2H_4NH)_xH$ where x is 1 to 5; and (c) reacting the resulting product with an alkenylsuccinic anhydride characterized by a molecular weight between about 400 and about 3,000.

12 Claims, No Drawings

LUBRICANT COMPOSITIONS CONTAINING METAL COMPLEXES AS DETERGENTS

BACKGROUND OF THE INVENTION

1. Field of the Invention

This invention relates to lubricant compositions and, n one of its aspects, relates more particularly to lubri:ant compositions having improved detergency proper-ies. Still more particularly, in this respect, the inven-ion relates to lubricant compositions in the form of oils of lubricating viscosities and greases containing addi:ives effective for improving the detergency properties of such lubricants.

2. Description of the Prior Art

Prior to the present invention complexes of the metal salts and detergents derived from polyamines have been the subject of a number of patents, for example, U.S. Pat. Nos. 3,642,847; 3,624,115; 3,649,661; 3,306,908 and 3,652,616. Other efforts towards improving detergency properties of lubricants have dealt with salts of carboxylic, sulfonic and phosporic acids or with inorganic salts.

SUMMARY OF THE INVENTION

In accordance with the present invention, there are provided improved lubricant compositions containing a detergency improving amount of a metal complex prepared by (a) reacting a salt or oxide of a metal capable of forming a Werner complex with a compound containing at least one phenolic group to yield the metal salt of said compound; (b) reacting the resulting metal salt with a polyamine having the formula $H_2N(C_2H_4NH)_xH$ where $x$ is 1 to 5; and (c) reacting the resulting product with an alkenylsuccinic anhydride characterized by a molecular weight between about 400 and about 3,000. The aforementioned detergency improving metal complex of the present invention may be incorporated in any lubricating media which may comprise liquid hydrocarbon oils in the form of either a mineral oil or a synthetic oil, or in the form of a grease in which any of the aforementioned oils are employed as a vehicle. In general, mineral oils employed as the lubricant, or grease vehicle, may be of any suitable lubricating viscosity range, as for example, from about 45 SSU at 100° F to about 6,000 SSU at 100° F, and preferably from about 50 to about 250 SSU at 210° F.

These oils may have viscosity indexes varying from below zero to about 100 or higher. Viscosity indexes from about 70 to about 95 are preferred. The average molecular weights of these oils may range from about 250 to about 800. Where the lubricant is to be employed in the form of a grease, the lubricating oil is generally employed in an amount sufficient to balance the total grease composition, after accounting for the desired quantity of the thickening agent, and other additive components to be included in the grease formulation.

In instances were synthetic oils, or synthetic oils employed as the vehicle for the grease, are desired in preference to mineral oils or in combination therewith, various compounds of this type may be successfully utilized. Typical synthetic vehicles include polyisobutylene, polybutenes, hydrogenated polydecenes, polypropylene glycol, polyethylene glycol, trimethylol propane esters, neopentyl and pentaerythritol esters, di(2-ethyl hexyl) sebacate, di(2-ethyl hexyl) adipate, dibutyl phthalate, fluorocarbons, silicate esters, silanes, esters of phosphorus-containing acids, liquid ureas, ferrocene derivatives, hydrogenated mineral oils, chain-type polyphenyl, siloxanes and silicones (polysiloxanes), alkyl-substituted diphenyl ethers typified by a butyl-substituted bis (p-phenoxy phenyl) ether, phenoxy phenylether, etc.

The detergency improving metal complexes may be employed in any amount sufficient to impart the desired degree of detergency properties to the lubricant composition. For many applications, these complexes may be employed in an amount from about 0.001% to about 20%, by weight, and preferably in an amount from about 1% to about 10%, by weight of the total weight of the lubricant composition.

Exemplary of the salt or oxide of a metal capable of forming a Werner complex are: zinc oxide, zinc carbonate, zinc acetate, nickel acetate, and nickel carbonate.

Exemplary of the compound containing at least one phenolic group for reaction with the aforementioned salt or oxide in reaction (a) are alkyl phenols in which the alkyl group contains from about 4 to about 30 carbon atoms, (b) alkyl phenols which have been reacted with sulfur halides to form products of the type

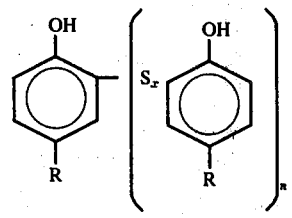

(c) alkyl phenols which have been dimerized to materials of the type

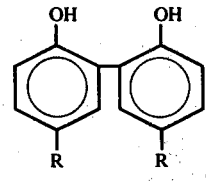

or crosslinked by reaction with aldehydes to

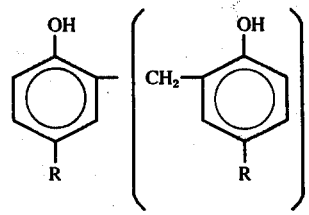

Exemplary of the polyamine in reaction (b) are: diethylenetriamine, triethylenetetramine, tetraethylenepentamine, polyethyleneimine, polypropyleneimine, iminobispropylamine, bis(aminopropyl)piperazine. In general, the polyamine can have a 1,2 or 1,3 diamine group or polymer thereof.

Exemplary of the alkenylsuccinic anhydride employed in reaction (c) are: materials having the structure

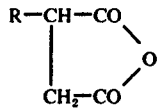

where R is a hydrocarbon polymer or copolymer such as polypropylene, polyisobutylene, ethylene-propylene copolymer, etc., with molecular weights in the range of 400–3,000.

Werner complexes are known to those skilled in the art and are characterized, in general, by salts joined by coordinate bonds, as disclosed, for example, in U.S. Pat. No. 3,102,096.

Exemplary of the metals that can be employed in forming the Werner complex of reaction (a) are metals having an atomic number from 24 to 30, and also cadmium and zirconium.

For many applications, alkenylsuccinic anhydrides having a molecular weight from about 400 to about 3,000 and, preferably, from about 700 to about 2,500 can be employed. Reaction (a) is preferably conducted at a temperature from about 40° to about 150° C, reaction (b) is preferably conducted at a temperature from about 25° to about 250° C, and reaction (c) is preferably conducted at a temperature from about 70 to about 250° C.

DESCRIPTION OF SPECIFIC EMBODIMENTS

The following exemplary and comparative data will serve to illustrate the marked improvement in detergency properites of the lubricants of the present invention over those of the prior art, and the superiority of the abovedescribed metal salt complexes as detergent additives.

Preparation of Dodecylphenol sulfide

Dodecylphenol sulfide was prepared employing the procedure disclosed in U.S. Pat. No. 2,916,454. Reaction was carried out employing a 6:5 mole ratio of dodecylphenol to sulfur chloride. The resulting dodecylphenol sulfide was found to have a molecular weight of 963 and was diluted with 25%, by weight, of process oil.

Preparation of the Zinc Salt

A neutral zinc salt was prepared employing 76.6 parts of the above-described dodecylphenol in process oil and a solution of 22 parts of zinc acetate dihydrate in 50 parts of water. The resulting materials were refluxed for one hour and then stripped of water and acetic acid at 150° C for a period of two hours over 2 mm. Hg. vacuum and filtered. The resulting product contained 7.69% zinc (calculated 7.87). The method of preparation of the zinc salt is not critical. The salt can be prepared from the alkyl phenol sulfide and a slurry of zinc oxide in water or by first making the sodium phenate and reacting the latter with zinc nitrate in alcohol.

EXAMPLE 1

Preparation of the Complex 348 parts of zinc salt described above was dissolved in 782 parts of process oil and heated to 70° C. 80 parts of tetraethylenepentamine were added over a 25-minute period during which time the mass first become very viscous and then turned fluid. 1,776 parts of polybutenylsuccinic anhydride (prepared from 1,300 molecular weight polybutene) was added and the mass was heated to 150° C, with water removal being conducted by distillation. The material was held at 150° C for 2 hours at a vacuum of 2 mm. Hg., and the final product was filtered. This material was found to contain 0.73% nitrogen and 0.80% zinc.

Evaluation of the Complex 37 parts of the above-prepared complex were compounded with an additive package containing 10 parts of zinc alkyldithiophosphate, 16 parts of calcium sulfonate, 4 parts of calcium phenate, 1 part acrylic ester polymer and 932 parts of solvent-refined SAE 30 grade lubricating oil. The material was compared to an uncomplexed commercially available polybutenylsuccinimide dispersant, compounded in the same manner. The diesel oil test disclosed in the following Table comprises individually blending the metal salt product of the present invention in a base fluid comprising a mixture of conventionally refined lube oil stocks derived from a Mid-continent crude oil. This base fluid also contained, by weight, 1.3% of an overbased magnesium sulfonate, 1.2% of zinc dithiophosphate and 1.0% of barium dithiophosphate. The base fluid and the same base fluid containing the aforementioned individual additives were next subjected for evaluation in a diesel oil test. This test was developed to produce deposits from the oxidaton of lubricating oil under conditions which closely approximate those found in the piston zone of a diesel engine. The test consists of an aluminum cylinder heated by radiant energy from an internal heater. The surface temperature of the heater is maintained at 575° F. during the test period (140 minutes). The shaft turns slowly (2 RPM) and into an oil sump where it picks up a thin film of oil. This thin film is carried into the oxidation zone where heated gases (moist air at 350° F is typically employed, however, nitrogen oxides, sulfur oxides and other mixtures can be used) to form oxidation deposits. These deposits can be affected by the detergent as the test cylinder rotates into the sump. The efficiency of the detergent is rated by the color and intensity of the deposit on the shaft at the end of the test. The comparative results obtained, employing this test, are shown in the following Table. The ASTM sequence V, described in STP 315F is employed for determination of sludge and varnish deposits in a gasoline automobile engine. The complex, as above described, was evaluated against the polybutenylsuccinimide standard dispersant.

TABLE

| | Standard | Example 1 |
|---|---|---|
| Diesel Oil Test (100 = Clean) | | |
| 70 min. | 83 | 95 |
| 140 min. | 69 | 81 |
| ASTM test | | |
| STP 315F (10 = Clean) | | |
| Sludge | 8.2 | 8.6 |
| Total Varnish | 6.4 | 7.6 |

TABLE-continued

| | Standard | Example 1 |
|---|---|---|
| Piston Varnish | 6.7 | 7.8 |

From the comparative data of the foregoing Table, it will be apparent that lubricants containing the abovedescribed novel reaction products of the present invention are markedly superior in detergency properties over those exhibited by the uncomplexed detergent itself.

In another modification, the metal complex can also be prepared by first reacting the alkenylsuccinic anhydride and the polyamine to form the corresponding alkenylsuccinimide and thereafter complexing it to the salt of the phenol.

While this invention has been described with reference to preferred compositions and components therefor, it will be understood, by those skilled in the art, that departure from preferred embodiments can be effectively made and are within the scope of the specification.

We claim:

1. A lubricant composition comprising a major proportion of a base oil selected from the group consisting of oils lubricating viscosity and grease thereof and a minor amount sufficient to improve detergency properties thereof of a metal complex prepared by (a) reacting a metal compound capable of forming a Werner complex selected from the group consisting essentially of zinc oxide, zinc carbonate, zinc acetate, zinc nitrate, nickel acetate, and nickel carbonate, at a temperature of from about 40° to about 150° C with a phenolic compound selected from the group consisting essentially of alkyl phenols containing from about 4 to about 30 carbon atoms, the reaction product of said alkyl phenols and a sulfur halide, dimers of said alkyl phenols, and said alkyl phenols which have been crosslinked with an aldehyde, to yield the metal salt of said phenolic compound; (b) reacting the resulting metal salt at a temperature of from about 25° to about 250° C with a polyamine having the formula $H_2N(C_2H_4NH)_xH$ where $x$ is 1 to 5; and (c) reacting the resulting product at a temperature of from about 70° to about 250° C with an alkenylsuccinic anhydride characterized by a molecular weight between about 400 and about 3,000.

2. The lubricant composition of claim 1 wherein said alkenylsuccinic anhydride has the following general structure:

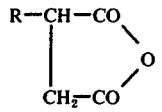

wherein R is a hydrocarbon selected from the group consisting essentially of polypropylene, polyisobutylene, and ethylenepropylene copolymer.

3. The lubricant composition of claim 1 wherein the phenolic compound is the reaction product of said alkyl phenol and a sulfur halide to form a product of the formula:

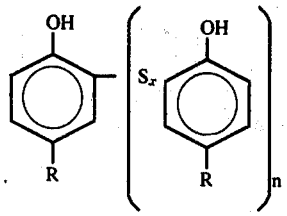

where R is an alkyl group containing from about 4 to about 30 carbon atoms.

4. The lubricant composition of claim 1 wherein the phenolic compound comprises alkyl phenols which have been dimerized to materials of the formula:

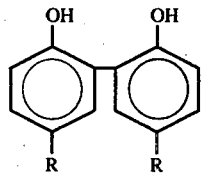

where R is an alkyl group containing from about 4 to about 30 carbon atoms.

5. The lubricant composition of claim 1 wherein the phenolic compound has been crosslinked by reaction with aldehydes to compounds of the formula:

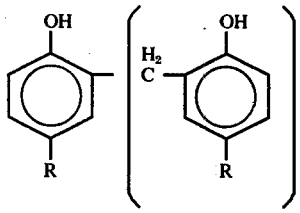

where R is an alkyl group containing from about 4 to about 30 carbon atoms.

6. The lubricant composition of claim 1 wherein said alkenylsuccinic anhydride has a molecular weight from about 700 to about 2,500.

7. The lubricant composition of claim 1 wherein said base oil comprises an oil of lubricating viscosity.

8. The lubricant composition of claim 1 wherein said base oil comprises a grease.

9. The lubricant composition of claim 1 wherein said detergency improving metal complex is present in an amount from about 0.001% to about 20%, by weight.

10. The lubricant composition of claim 1 wherein said detergency improving metal complex is present in an amount from about 1% to about 10%, by weight.

11. A metal complex of an alkylsuccinimide prepared by (a) reacting a metal compound capable of forming a Werner complex selected from the group consisting essentially of zinc oxide, zinc carbonate, zinc acetate, zince nitrate, nickel acetate, and nickel carbonate, at a temperature of from about 40° to about 150° C, with a phenolic compound selected from the group consisting essentially of alkyl phenols containing from about 4 to about 30 carbon atoms, the reaction product of said alkyl phenols and a sulfur halide, dimers of said alkyl phenols, and said alkyl phenols which have been crosslinked with an aldehyde, to yield the metal salt of said phenolic compound; (b) reacting the resulting metal salt at a temperature of from about 25° to about 250° C with a polyamine having the formula $H_2N(C_2H_4NH)_xH$ where $x$ is 1 to 5; and (c) reacting the resulting product at a temperature of from about 70° to about 250° C with said alkenylsuccinic anhydride further characterized by a molecular weight between about 400 and about 3,000.

12. The metal complex defined by claim 11 wherein said alkenylsuccinic anhydride has a molecular weight from about 700 to about 2,500.

* * * * *